US006448943B1

(12) United States Patent
Wallach

(10) Patent No.: US 6,448,943 B1
(45) Date of Patent: Sep. 10, 2002

(54) ANTENNA SYSTEM HAVING AN IMPROVED ANTENNA SUPPORT STRUCTURE

(75) Inventor: Andrew R. Wallach, San Jose, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/900,387

(22) Filed: Jul. 6, 2001

(51) Int. Cl.[7] ..... H01Q 15/20
(52) U.S. Cl. ..... 343/915; 343/878; 343/DIG. 2
(58) Field of Search ..... 343/878, 840, 343/912, 915, DIG. 2; H01Q 15/20

(56) References Cited

U.S. PATENT DOCUMENTS 5,644,322 A * 7/1997 Hayes et al. ..... 343/915
5,929,817 A * 7/1999 Clark ..... 343/713
6,064,344 A * 5/2000 Walton ..... 343/704
6,072,991 A * 6/2000 Paul et al. ..... 455/73
6,075,497 A * 6/2000 Chen et al. ..... 343/840
6,081,235 A * 6/2000 Romanofsky et al. ..... 343/700 MS

* cited by examiner

*Primary Examiner*—Tho Phan
(74) *Attorney, Agent, or Firm*—Kenneth W. Float

(57) ABSTRACT

An antenna system and improved antenna support structure that is preferably used on a spacecraft. An exemplary antenna system comprises an antenna dish, an antenna positioning mechanism, and the present antenna support structure coupled between the antenna dish and antenna positioning mechanism. The antenna support structure comprises a composite ring attached to a rear surface of the antenna dish and a boom structure coupled to the composite ring and to the antenna positioning mechanism that comprises a plurality of tubular fingers that interconnect the composite ring and the antenna positioning mechanism. The boom structure may further comprise one or more lateral supports that interconnect the plurality of tubular fingers. The composite ring is preferably disposed in a plane containing the center of gravity of the antenna dish. The composite ring, tubular fingers, and lateral supports preferably comprise graphite fibers. The composite ring, tubular fingers, and lateral supports may have rectangular or circular cross sections.

20 Claims, 1 Drawing Sheet

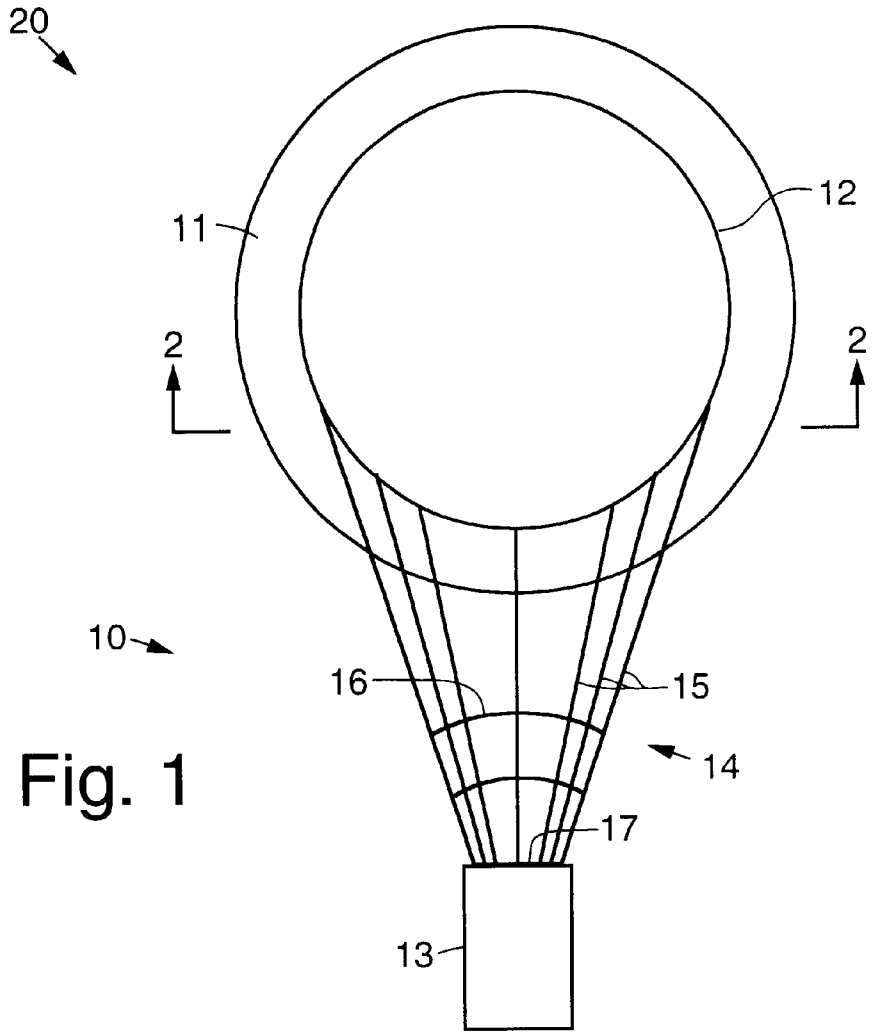
Fig. 1
Fig. 2
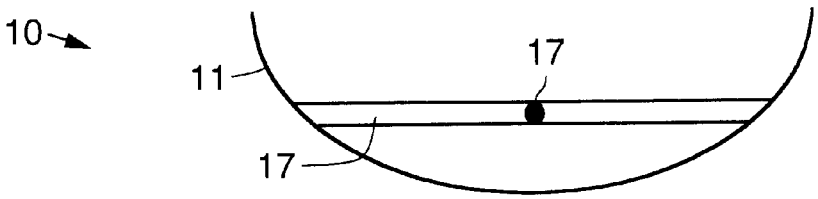

ANTENNA SYSTEM HAVING AN IMPROVED ANTENNA SUPPORT STRUCTURE

BACKGROUND

The present invention relates generally to antenna systems, and more particularly, to an antenna system and improved antenna support structure for use on a spacecraft.

Antenna systems used on spacecraft employ an antenna support structure to secure them to a spacecraft and deploy an antenna once the spacecraft is in orbit. Conventional antenna support structures have not had suitable profiles that allow antenna nesting (stacking) when they are disposed within available launch vehicle fairings. Also, conventional antenna support structures have not been readily adaptable to support different antenna dishes without the requirement of substantial additional analysis. Furthermore, conventional antenna support structures are not easily changed to allow support of different antenna dishes.

It is therefore an objective of the present invention to provide for an antenna system and improved antenna support structure for use on a spacecraft.

SUMMARY OF THE INVENTION

The present invention provides for an antenna system and improved antenna support structure that is preferably used on a spacecraft. An exemplary antenna system comprises an antenna dish, an antenna positioning mechanism, and the antenna support structure coupled between the antenna dish and antenna positioning mechanism. The antenna support structure preferably comprises a composite ring attached to a rear surface of the antenna dish and a boom structure coupled to the composite ring and to the antenna positioning mechanism. The boom structure preferably comprises a plurality of tubular fingers that interconnect the composite ring and the antenna positioning mechanism. The plurality of tubular fingers meet at a common element (or meet forming one element). The boom structure may further comprise one or more lateral supports that interconnect the plurality of tubular fingers.

The composite ring is preferably disposed in a plane containing the center of gravity of the antenna dish. The composite ring, tubular fingers, and lateral supports preferably comprise graphite fibers. The composite ring, tubular fingers, and lateral supports may have rectangular or circular cross sections.

The present invention is directed toward reducing mass, enhancing stiffness, creating a shallower antenna system profile, and providing a structural configuration for the antenna support structure that is adaptable to change. The present antenna support structure has a shallower profile that expedites antenna nesting (stacking) while fitting within available launch vehicle fairings. The structural configuration of the antenna support structure is such that elements may be added or subtracted to accommodate various antenna dishes without substantial additional analysis.

Critical advantages of the antenna support structure are that torsion on the antenna about an axis that is parallel to the support system is converted to and resisted, primarily, by bending in the support boom. In addition, loads transferred through the "ring", attached to the antenna dish, are distributed to multiple connection points in the boom allowing for a smaller ring cross section than conventional backup structures.

Bending within the fingers of the boom structure is preferred over pure torsion because bending is resisted better than torsion in composite systems. The ring is preferably attached to the antenna dish in the same plane as its center of mass. This reduces eccentricity of the antenna mass with respect to the boom, lowering torsion on antenna support structure during launch of the spacecraft.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates a bottom view of an antenna system employing an exemplary antenna support structure in accordance with the principles of the present invention; and FIG. 2 illustrates a side view of the antenna system and support structure shown in FIG. 1, taken along the lines 2—2.

DETAILED DESCRIPTION

Referring to the sole drawing figures, FIG. 1 is a bottom view of an antenna system 20 employing an exemplary antenna support structure 10 in accordance with the principles of the present invention, while FIG. 2 is a side view of the antenna system 20 and support structure 10 shown in FIG. 1, taken along the lines 2—2.

The antenna system 20 comprises an antenna dish 11 that is coupled to an antenna positioning mechanism 13 by way of the exemplary antenna support structure 10. The exemplary antenna support structure 10 comprises a composite ring 12 having a closed shape attached to a rear surface of the antenna dish 11. The composite ring 12 preferably comprises graphite fibers. The composite ring 12 may have a rectangular or circular cross section, for example. The composite ring 12 is disposed (located) in a plane containing the center of gravity of the antenna dish 11, which is illustrated in FIG. 2.

The composite ring 12 that is attached to the antenna dish 11 is coupled to the antenna positioning mechanism 13 by means of a boom structure 14. The boom structure 14 comprises a plurality of tubular fingers 15 that interconnect the composite ring 12 and meet at a common element 17 (or meet forming one element 17). The element may then be connected to the antenna positioning mechanism 13. The tubular fingers 15 preferably comprise graphite fibers. The tubular fingers 15 may have a rectangular or circular cross section, for example.

Additional lateral supports 16 may be used to interconnect the plurality of tubular fingers 15. The lateral supports 16 preferably comprise graphite fibers. The lateral supports 16 may also have a rectangular or circular cross section, for example.

The present invention provides for reducing mass, enhanced stiffness of the antenna system 20. The present invention provides for a shallower profile of the antenna system 20. The structural configuration of the antenna support structure 10 is adaptable to change without substantial structural analysis. The antenna support structure 20 has a shallower profile that allows antenna nesting (stacking), and allows the antenna system to fit within available launch vehicle fairings. The antenna support structure may have additional elements added thereto or subtracted therefrom to accommodate various antenna dishes 11 without substantial additional analysis.

Torsion on the antenna dish 11 about an axis that is parallel to the antenna support structure 10 is converted to and primarily resisted by bending in the support boom structure 14. In addition, loads transferred through the ring 12 attached to the antenna dish 11 are distributed to multiple connection points in the boom structure 14, allowing for a smaller ring 12 cross section compared to conventional antenna backup structures.

Bending within the fingers 15 of the boom structure 14 is preferred over pure torsion because bending is resisted better than torsion in composite systems. The ring 12 is preferably attached to the antenna dish 11 in the same plane as its center of mass, which reduces eccentricity of the antenna mass with respect to the boom 14, lowering torsion on the antenna support structure 10 during launch of the spacecraft.

Thus, improved antenna support structure have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An antenna system comprising:

an antenna dish;

an antenna positioning mechanism; and an antenna support structure coupled between the antenna dish and antenna positioning mechanism that comprises a composite ring attached to a rear surface of the antenna dish that is disposed in a plane containing the center of gravity of the antenna dish, and a boom structure coupled to the composite ring and to the antenna positioning mechanism that comprises a plurality of tubular fingers that interconnect the composite ring and the antenna positioning mechanism.

2. The antenna system recited in claim 1 wherein the composite ring comprises graphite fibers.

3. The antenna system recited in claim 1 wherein the composite ring has a rectangular cross section.

4. The antenna system recited in claim 1 wherein the composite ring has a circular cross section.

5. The antenna system recited in claim 1 wherein the tubular fingers comprise graphite fibers.

6. The antenna system recited in claim 1 wherein the tubular fingers have a rectangular cross section.

7. The antenna system recited in claim 1 wherein the tubular fingers have a circular cross section.

8. The antenna system recited in claim 1 wherein the boom structure further comprises one or more lateral supports that interconnect the plurality of tubular fingers.

9. The antenna system recited in claim 8 wherein the lateral supports comprise graphite fibers.

10. The antenna system recited in claim 8 wherein the lateral supports have a rectangular cross section.

11. The antenna system recited in claim 8 wherein the lateral supports have a circular cross section.

12. The antenna system recited in claim 1 wherein the plurality of tubular fingers meet at a common element that is coupled to the antenna positioning mechanism.

13. The antenna system recited in claim 1 wherein the plurality of tubular fingers meet to form one element that is coupled to the antenna positioning mechanism.

14. Apparatus for use with an antenna system comprising an antenna dish and an antenna positioning mechanism, comprising:

an antenna support structure coupled between the antenna dish and antenna positioning mechanism that comprises a composite ring attached to a rear surface of the antenna dish that is disposed in a plane containing the center of gravity of the antenna dish, and a boom structure coupled to the composite ring and to the antenna positioning mechanism that comprises a plurality of tubular fingers that interconnect the composite ring and the antenna positioning mechanism.

15. The apparatus recited in claim 14 Wherein the composite ring comprises graphite fibers.

16. The apparatus recited in claim 14 wherein the tubular fingers comprise graphite fibers.

17. The apparatus recited in claim 14 wherein the boom structure further comprises one or more lateral supports the interconnect the plurality of tubular fingers.

18. The apparatus recited in claim 17 wherein the lateral supports comprise graphite fibers.

19. An antenna system comprising:

an antenna dish;

an antenna positioning mechanism; and an antenna support structure coupled between the antenna dish and antenna positioning mechanism that comprises a composite ring attached to a rear surface of the antenna dish that is disposed in a plane containing the center of gravity of the antenna dish, and a boom structure coupled to the composite ring and to the antenna positioning mechanism that comprises a plurality of tubular fingers that meet at a common element and interconnect the composite ring and the antenna positioning mechanism.

20. An antenna system comprising:

an antenna dish;

an antenna positioning mechanism; and an antenna support structure coupled between the antenna dish and antenna positioning mechanism that comprises a composite ring attached to a rear surface of the antenna dish that is disposed in a plane containing the center of gravity of the antenna dish, and a boom structure coupled to the composite ring and to the antenna positioning mechanism that comprises a plurality of tubular fingers that meet to form one element and interconnect the composite ring and the antenna positioning mechanism.

* * * * *